US005311201A

United States Patent [19]

Lillie et al.

[11] Patent Number: 5,311,201

[45] Date of Patent: May 10, 1994

[54] MULTI-BAND ANTENNA

[75] Inventors: Michael R. Lillie; Valdis V. Liepa, both of Ann Arbor, Mich.

[73] Assignee: Tri-Band Technologies, Inc., Oxford, Mich.

[21] Appl. No.: 767,288

[22] Filed: Sep. 27, 1991

[51] Int. Cl.[5] ..... H01Q 5/02; H01Q 9/18

[52] U.S. Cl. ..... 343/791; 343/715

[58] Field of Search ..... 343/715, 790–792, 343/793; H01Q 9/04, 9/16, 21/10, 21/30, 9/22, 9/18, 5/00–5/02

[56] References Cited

U.S. PATENT DOCUMENTS

| | | | |
|---|---|---|---|
| 3,139,620 | 6/1964 | Leidy et al. | 343/792 |
| 3,576,578 | 4/1971 | Harper | 343/792 |
| 3,680,131 | 7/1972 | Hall et al. | 343/710 |
| 4,352,109 | 9/1982 | Reynolds | 343/792 |
| 4,647,941 | 3/1987 | Myer | 343/792 |
| 4,725,846 | 2/1988 | Hendershot | 343/792 |
| 4,734,703 | 3/1988 | Nakase et al. | 343/715 |
| 4,748,450 | 5/1988 | Hines et al. | 343/715 |
| 5,079,562 | 1/1992 | Yarsunas et al. | 343/792 |

*Primary Examiner*—Michael C. Wimer
*Attorney, Agent, or Firm*—Krass & Young

[57] ABSTRACT

A multi-band antenna includes conductive tubular section that provides the major physical support for the antenna and functions as the major element of the antenna on the long wavelength band and a half wavelength center feed dipole with a choke located at the end of the tubular section that serves and the short wavelength antenna. The half wavelength dipole includes a coaxial cable disposed within the tubular section extending a quarter wavelength of the short wavelength band beyond the tubular section. A solid conductor of a quarter wavelength forms an extension of the central conductor of the coaxial cable. A rigid dielectric cylinder accommodates the extension of the coaxial cable and the solid conductor providing physical support and rigidity. A choke includes a short between the outer conductive shield of the coaxial cable and the tubular section is located one quarter wavelength from the remote end of the tubular section. In addition, the length of the insertion section of the dielectric cylinder into the tubular section provides tuning. The outside diameters of the tubular section and the dielectric cylinder are the same allowing permits a conformal coating to cover the tubular section and the dielectric cylinder. This conformal coating provides environmental protection and makes the antenna visually similar to the prior art whip antenna.

8 Claims, 1 Drawing Sheet

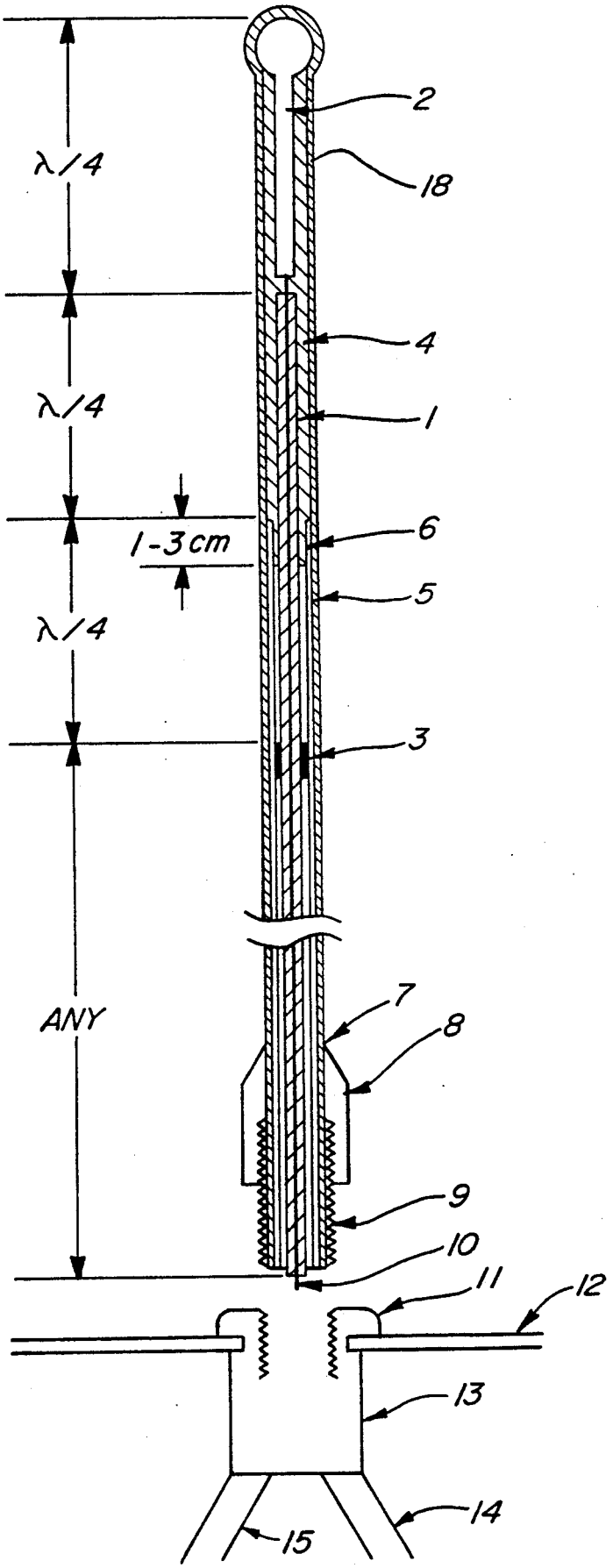
λ/4
λ/4
1-3cm
λ/4
ANY
2
18
4
1
6
5
3
7
8
9
10
11
12
13
14
15

MULTI-BAND ANTENNA

TECHNICAL FIELD OF THE INVENTION

This invention is a combination high and low frequency antenna designed to resemble the standard AM/FM whip antenna used on automobiles.

BACKGROUND OF THE INVENTION

This invention is in the field of antennas, particularly vehicle antennas having multi-band capability. Motor vehicles have for many years been equipped with radio receivers for entertainment and information. The typical passenger automobile is equipped with a combined AM/FM radio for this purpose. These radios typically use a single whip antenna for receiving radio signals.

More recently there is much interest in high frequency mobile radio communication systems in motor vehicles. This interest particularly relates to mobile cellular telephones. Cellular telephone systems operate at much higher frequencies than the AM or even the FM broadcast bands. The AM broadcast band is roughly centered around 1 MHz and the FM broadcast band is roughly centered around 100 MHz. The cellular telephone system employs one band for transmission and a second nearby band for reception. These two bands are in the range between 800 and 900 MHz. Because of the difference in frequency between the cellular telephone band and the AM and FM bands, it is typical in the prior art to use a separate antenna for the mobile communications system.

There are problems with the use of a separate antenna. Modification of the vehicle is often required to accommodate the separate antenna. This often involves drilling holes for mounting the antenna and the like. The introduction of cellular telephone systems with separate antennas precipitated numerous instances of theft or vandalism of the mobile communications equipment. The separate antenna used by the mobile communications equipment system serves to alert potential thieves and vandals of the presence of the mobile communications equipment.

There have been attempts in the prior art to produce a single antenna which is capable of operating on the AM/FM bands and the higher frequency mobile communication bands without success. There is therefore a need in art for a single antenna which can operate on these bands and which is visually indistinguishable from the prior art AM/FM whip antenna.

SUMMARY OF THE INVENTION

This invention is a multi-band antenna for operation on at least one low frequency band, such as the AM broadcast band or both the AM and FM broadcast bands, and a much higher frequency mobile communications band. This antenna is constructed in a manner to be visually very similar to a prior art AM/FM whip antenna. A conductive tubular section provides the major physical support for the antenna and functions as the major element of the antenna on the AM and FM broadcast bands. A half wavelength center feed dipole with a choke located at the end of the tubular section serves as the antenna on the higher frequency mobile communications band.

The half wavelength dipole includes a coaxial cable disposed within the tubular section. This coaxial cable has an outer conductive shield generally insulated from the tubular section, a dielectric core and a central conductor. The coaxial cable extends a quarter wavelength of the short wavelength band beyond the remote end of the tubular section. A solid conductor of a quarter wavelength forms an extension of the central conductor of the coaxial cable. A rigid dielectric cylinder accommodates the extension of the coaxial cable and the solid conductor. This dielectric cylinder has an extension disposed a predetermined length into the remote end of the tubular section, and provides physical support and rigidity for half wavelength dipole.

The choke includes a short between the outer conductive shield of the coaxial cable and the tubular section. This short is located approximately one quarter wavelength from the remote end of the tubular section. In addition, the length of the insertion section of the dielectric cylinder into the tubular section provides tuning.

A coupling device at the near end of the antenna connects a long wavelength coaxial feedline connector electrically to the tubular section and a short wavelength coaxial connector to the coaxial cable. The outside diameters of the tubular section and the dielectric cylinder are the same. This permits a conformal coating to cover the tubular section and the dielectric cylinder. This conformal coating provides environmental protection and makes the antenna visually similar to the prior art whip antenna.

BRIEF DESCRIPTION OF THE DRAWINGS

These and other objects and aspects of the present invention will become clear from the following description of the invention, in which the figure illustrates in cross section an example of the preferred embodiment of this invention.

DETAILED DESCRIPTION OF THE PREFERRED EMBODIMENTS

The present invention presents in a single structure an antenna having acceptable performance for an AM/FM radio used for entertainment and information purposes and a high frequency dual-band mobile communication system. The high frequency portion of this multi-band antenna is made up of a number of individual pieces sized specifically to resonate and produce the highest gain at the center frequency of the transmission band of a dual-band mobile communications system. Such dual-band mobile communications systems include the well known cellular telephone system. These dual-band mobile communication systems usually include signal processing and enhancement circuitry that negate the need for a high gain signal in the receiver of the system.

The wavelength of the central frequency of the transmission band is expressed as $\lambda$. A number of the components of this antenna have specific length requirements relative to the selected wavelength $\lambda$. Other components have dimensions which can vary depending upon the total desired length of the overall assembly. A detailed description of the individual parts of this antenna follows with reference to the single figure.

A rigid conductive tubular section 5 serves as the major structural support for the antenna. Tubular section 5 has an outside diameter of approximately 0.155 inches and a length equal to the total length of the antenna less than $\lambda/2$. It is constructed of steel or aluminum.

Semi-rigid coaxial cable 1 is disposed inside tubular section 5. Coaxial cable 1 has a characteristic impedance of 50Ω and a length approximately λ/4 shorter than the overall height of the completed antenna. Coaxial cable 1 preferably has an outer conductive shield with a diameter of 0.047 inches. This outer shield encloses a central conductor of number 29 gauge solid copper wire. The dielectric core is preferably formed of Teflon. The outer shield of cable 1 is generally insulated from tubular section 5. The length of coaxial cable 1 is such that it extends approximately λ/4 beyond the end of tubular section 5. Note that tubular section 5 and coaxial cable 1 may be constructed in any appropriate length desired.

A solid conductor 2 is disposed at the end of the antenna. Conductor 2 forms a continuation of the center conductor of coaxial cable 1 and is electrically connected to the center conductor of coaxial cable 1. Conductor 2 extends beyond the shield of coaxial cable 1 a length of approximately λ/4. It has an outside diameter about the same as the outside diameter of the outer conductor of coaxial cable 1.

The end of coaxial cable 1 and conductor 2 are supported by rigid dielectric cylinder 4. Dielectric cylinder 4 has a length of slightly more than λ/2 and an inside diameter of 0.050 inches. This inside diameter permits insertion of coaxial cable 1 and conductor 2 into dielectric cylinder 4. Dielectric cylinder 4 has an outside diameter equal to the outside diameter of tubular section 5. A continuation section 6 of dielectric cylinder 4 is inserted into tubular section 5. This continuation section 6 has a length in the range from 1 to 3 centimeters and an outside diameter sized to fit the inside diameter of tubular section 5. This continuation section 6 permits rigid coupling between tubular section 5 and dielectric cylinder 4, thereby forming a stable unit.

Dielectric cylinder 4 must have certain characteristics. It must be formed of a material having a low dielectric constant. It must be very rigid or alternatively capable of flexing and returning to its original shape. Dielectric cylinder 4 must be constructed of material capable of bonding with tubular section 5. Depending on the particular application, nylon, fiberglass or some composite material are believed suitable.

As previously mentioned, the outer shield of coaxial cable 1 is generally insulated from tubular section 5. Electrical short 3 is the exception. Electrical short 3 is disposed a distance of approximately λ/4 from the end of tubular section 5 and approximately λ/2 from the end of coaxial cable 1. Electrical short 3 is preferably made of a small cylinder of conductive material with an inside diameter sized to fit the outer shield of coaxial cable 1 and an outside diameter sized to fit inside tubular section 5. Electrical short 3 electrically connects the outer shield of coaxial cable 1 and tubular section 5.

The antenna includes an assembly for mounting on vehicle fender 12 and for separate coupling to an AM/FM radio receiver and to a communications system. An insulative cylinder 7 isolates the tubular section 5 from the body of the vehicle as it passes through the removable base 8 and the threaded hollow stud 9. Base 8 has an appearance similar to the mounting unit used on most replaceable AM/FM vehicle antennas. Vehicular mounting unit 11 is similar in outward appearance with mounting units used on most AM/FM replaceable antennas. Vehicular mounting unit 11 includes a female receptacle such as typically used in a standard coax connector that mates with male pin 10. Male pin 10 is similar to that typically used in a standard coax connector and is electrically connected to the central conductor of coaxial cable 1. Multi-purpose module 13: 1) secures mounting unit 11 to the vehicle fender 12; 2) splits and filters the antenna signal; and 3) mechanically secures the junction with flexible coaxial cables 14 and 15. Flexible coaxial cable 14 feeds the vehicle AM/FM radio receiver. Flexible coaxial cable 15 feeds the multiband communication system. The completed multiband antenna includes a conformal coating 18 of an appropriate material to provide visual continuity and environmental protection. This conformal coating 18 must: 1) have a low dielectric constant and low electrical loss; 2) be capable of coating and bonding with both tubular section 5 and dielectric cylinder 4; 3) be resistant to scratches, gouges, weather and road salt; 4) be easy to apply; and 5) be low cost.

The multi-band antenna presents different electrical radiation characteristics to the different bands. When used with the relatively lower frequency AM/FM radio receiver, coaxial cable 14 is substantially connected to tubular section 5. Tubular section 5 operates in the same manner as the typical prior art whip antenna. When used with the higher frequency of the communication system, coaxial cable 15 is substantially connected to coaxial cable 1. In this high frequency band the antenna can be described as λ/2 center feed dipole with a choke.

The length of coaxial cable 1 which extends beyond conductive sleeve 5 and the length of conductor 2 determine the coarse tuning of the high frequency radiation characteristic of the antenna. A choke structure including electrical short 3 and continuation section 6 of dielectric cylinder 4 determines the fine tuning. Varying the length of continuation section 6 fine tunes the frequency of the choke or trap. In the preferred embodiment these structures are of a size to provide best performance at the center wavelength λ of transmission band of the communications system. This tuning will usually provide acceptable performance on the nearby reception band of the communications system.

This construction is advantageous for several reasons. First, this construction provides in a single antenna acceptable performance on several bands. This eliminates the need for a separate antenna for the vehicle AM/FM radio receiver and the communications system. Second, this construction is very similar in appearance to a conventional AM/FM whip antenna. Thus potential vandals or thieves are not alerted to the presence of the communications system.

We claim:

1. A multi-band antenna for operation on a first long wavelength band and a second wavelength band shorter than said first wavelength band comprising:

a conductive tubular member having first and second ends;

a coaxial cable having an outer conductive shield, a dielectric core and a central conductor, said coaxial cable having a first section disposed within said tubular member, said coaxial cable having an extension section with a first end of said extension section extending a first predetermined length beyond said first end of said tubular member;

a solid conductor having a first end electrically connected to said central conductor of said coaxial cable at said first end thereof, said solid conductor extending said first predetermined length beyond said first end of said extension section;

an electrical short disposed within said tubular member at said first predetermined length from said first end of said tubular member for electrically connecting said tubular member and said outer conductive shield of said coaxial cable with the remainder of said outer conductive shield being electrically insulated from the remainder of said tubular member; and a rigid dielectric cylinder including (1) a first section of twice said first predetermined length having said first predetermined length of said coaxial cable extending beyond said first end of said tubular member and said solid conductor disposed therein and (2) a second section disposed a second predetermined length into said first end of said tubular member, wherein said dielectric cylinder provides mechanical support for said extension section of said coaxial cable.

2. The multi-band antenna claimed in claim 1, wherein:

said first predetermined length is one quarter of the center wavelength of the second wavelength band.

3. The multi-band antenna claimed in claim 1, wherein:

said second predetermined length of said second section of said dielectric cylinder is selected to provide optimum resonance at the center wavelength of the second wavelength band.

4. The multi-band antenna claimed in claim 1, wherein:

said tubular member has a first outside diameter;

said coaxial cable has a second outside diameter;

said solid conductor has said second outside diameter; and said dielectric cylinder has an inside diameter accommodating said second outside diameter of said coaxial cable and of said solid conductor, said first section of said dielectric cylinder having said first outside diameter.

5. The multi-band antenna claimed in claim 4, further comprising:

a conformal coating covering said tubular member and said dielectric cylinder.

6. A multi-band antenna for operation on a first wavelength band and a second wavelength band shorter than said first wavelength band comprising:

a conductive tubular member having first and second ends and a first outside diameter;

a coaxial cable disposed within said tubular section, having an outer conductive shield, a dielectric core and a central conductor, said coaxial cable having an extension section with a first end of said extension section extending a length of one quarter of the center wavelength of the second wavelength band beyond said first end of said tubular member, said coaxial cable having a second outside diameter;

a solid conductor having a first end electrically connected to said central conductor of said extension section at said first end thereof, said solid conductor extending a length of one quarter of the center wavelength of the second wavelength band beyond said first end of said extension section, said solid conductor having said second outside diameter;

a rigid dielectric cylinder including (1) a first section of a length of one half of the center wavelength of the second wavelength band having said extension section of said coaxial cable and said solid conductor disposed therein and (2) a second section disposed a second predetermined length into said first end of said tubular section, said dielectric cylinder having an inside diameter accommodating said second outside diameter of said coaxial cable and of said solid conductor, said first section of said dielectric cylinder having said first outside diameter, wherein said dielectric cylinder provides mechanical support for said first predetermined length of said extension section extending beyond said first end of said tubular member and said solid conductor; and, an electrical short disposed within said tubular section at a length of one quarter of the center wavelength of the second wavelength band from said first end of said tubular member for electrically connecting said tubular member and said outer conductive shield of said coaxial cable, with the remainder of said outer conductive shield being electrically insulated from the remainder of said tubular member.

7. The multi-band antenna claimed in claim 6, wherein:

said second predetermined length of said second section of said dielectric cylinder is selected to provide optimum resonance at the center wavelength of the second wavelength band.

8. The multi-band antenna claimed in claim 6, further comprising:

a conformal coating covering said tubular member and said dielectric cylinder.

* * * * *